US006219973B1

(12) United States Patent
Lafferty

(10) Patent No.: US 6,219,973 B1
(45) Date of Patent: Apr. 24, 2001

(54) STRUCTURE STABILIZING SYSTEM AND METHOD

(76) Inventor: George A. Lafferty, 4801 Neosho Ave., Roeland Park, KS (US) 66205

( * ) Notice: Subject to any disclaimer, the term of this patent is extended or adjusted under 35 U.S.C. 154(b) by 0 days.

(21) Appl. No.: 09/476,913

(22) Filed: Jan. 4, 2000

(51) Int. Cl.[7] ..... E04B 7/00

(52) U.S. Cl. ..... 52/23; 52/92.1; 52/93.2; 52/262; 52/702; 52/712; 52/745.06

(58) Field of Search ..... 52/22, 23, 92.1, 52/92.2, 93.2, 262, 702, 745.06, DIG. 11, 3, 712

(56) References Cited

U.S. PATENT DOCUMENTS

| | | | | |
|---|---|---|---|---|
| 573,452 | * | 12/1896 | Delahunt | 52/92.2 |
| 1,192,027 | * | 7/1916 | Acheson | 52/23 |
| 3,309,822 | * | 3/1967 | Dunkin | 52/23 |
| 3,335,531 | * | 8/1967 | Grimelli et al. | 52/23 |
| 5,303,520 | * | 4/1994 | Gozdziak | 52/92.2 |
| 5,491,935 | * | 2/1996 | Coxum | 52/92.2 |
| 5,537,786 | | 7/1996 | Lozier et al. . | |
| 5,570,545 | | 11/1996 | Adams . | |
| 5,579,794 | | 12/1996 | Sporta . | |
| 5,687,512 | | 11/1997 | Spoozak et al. . | |
| 5,701,715 | * | 12/1997 | Masters et al. | 52/23 X |
| 5,819,477 | | 10/1998 | Gaffney . | |
| 5,881,499 | | 3/1999 | Luzzi . | |
| 6,145,268 | * | 11/2000 | Korzen | 52/712 |

* cited by examiner

*Primary Examiner*—Beth A. Stephan
*Assistant Examiner*—Brian E. Glessner
(74) *Attorney, Agent, or Firm*—Joseph N. Breaux

(57) ABSTRACT

A structure stabilizing system that includes a length of cabling and a number of joist and rafter reinforcing cable guides. Each of the joist and rafter reinforcing cable guides includes an L-shaped joist securing plate assembly, a rafter securing plate, and a cable guide tube assembly. The structure stabilizing method includes the steps of a) providing a number of joist and rafter reinforcing cable guides as described above; b) attaching one each of the joist and rafter reinforcing cable guides to a number of sets of ceiling joists and rafters along each side of the building; c) threading a length of cabling through each of the cable guide tubes of each of the attached joist and rafter reinforcing cable guides; and d) anchoring the ends of the cable to the foundation of the structure to be stabilized.

2 Claims, 3 Drawing Sheets

STRUCTURE STABILIZING SYSTEM AND METHOD

TECHNICAL FIELD

The present invention relates to building stabilizing systems and more particularly to a structure stabilizing system and method wherein the structure stabilizing system includes a length of cabling and a number of joist and rafter reinforcing cable guides; each of the joist and rafter reinforcing cable guides including an L-shaped joist securing plate assembly, a rafter securing plate, and a cable guide tube assembly; the L-shaped joist securing plate assembly including a vertical joist contact plate and a horizontal joist contact plate integrally formed with and orthogonally oriented with respect to the vertical joist contact plate; the vertical joist contact plate having two fastener apertures provided therethrough; the rafter securing plate being integrally formed with and orthogonally oriented with respect to a side edge of the horizontal joist contact plate and lying in a plane parallel to a plane defined by the vertical joist contact plate; the cable guide tube assembly including a tube support plate and a cable guide tube; the tube support plate having a cable passage aperture formed therethrough and being integrally formed with and extending from a side edge of the rafter securing plate perpendicularly oriented to the horizontal joist contact plate and having a bottom edge collinear with a fold line defining the edge between the horizontal joist contact plate and the rafter securing plate; the cable guide tube having a first open end defined by a tube end rigidly secured to the tube support plate such that a cable passage formed through the cable guide tube is in connection with the cable passage aperture and a longitudinal axis of the cable guide tube is oriented in parallel with a plane defined by the horizontal joist contact plate; and wherein the structure stabilizing method includes the steps of a) providing a number of joist and rafter reinforcing cable guides as described above; b) attaching one each of the joist and rafter reinforcing cable guides to a number of sets of ceiling joists and rafters along each side of the building; c) threading a length of cabling through each of the cable guide tubes of each of the attached joist and rafter reinforcing cable guides; and d) anchoring the ends of the cable to the foundation of the structure to be stabilized.

BACKGROUND ART

Each year storms tear the roofs off many building because the buildings have not been adequately constructed or stabilized. It would be a benefit, therefore, to have a structure stabilizing system that could be used to stabilize new and old buildings so that the likelihood of damage from storms is reduced.

GENERAL SUMMARY DISCUSSION OF INVENTION

It is thus an object of the invention to provide a structure stabilizing system that includes a length of cabling and a number of joist and rafter reinforcing cable guides; each of the joist and rafter reinforcing cable guides including an L-shaped joist securing plate assembly, a rafter securing plate, and a cable guide tube assembly; the L-shaped joist securing plate assembly including a vertical joist contact plate and a horizontal joist contact plate integrally formed with and orthogonally oriented with respect to the vertical joist contact plate; the vertical joist contact plate having two fastener apertures provided therethrough; the rafter securing plate being integrally formed with and orthogonally oriented with respect to a side edge of the horizontal joist contact plate and lying in a plane parallel to a plane defined by the vertical joist contact plate; the cable guide tube assembly including a tube support plate and a cable guide tube; the tube support plate having a cable passage aperture formed therethrough and being integrally formed with and extending from a side edge of the rafter securing plate perpendicularly oriented to the horizontal joist contact plate and having a bottom edge collinear with a fold line defining the edge between the horizontal joist contact plate and the rafter securing plate; the cable guide tube having a first open end defined by a tube end rigidly secured to the tube support plate such that a cable passage formed through the cable guide tube is in connection with the cable passage aperture and a longitudinal axis of the cable guide tube is oriented in parallel with a plane defined by the horizontal joist contact plate.

It is a further object of the invention to provide a structure stabilizing method that includes the steps of a) providing a number of joist and rafter reinforcing cable guides as described above; b) attaching one each of the joist and rafter reinforcing cable guides to a number of sets of ceiling joists and rafters along each side of the building; c) threading a length of cabling through each of the cable guide tubes of each of the attached joist and rafter reinforcing cable guides; and d) anchoring the ends of the cable to the foundation of the structure to be stabilized.

Accordingly, a structure stabilizing system and method is provided. The structure stabilizing system includes a length of cabling and a number of joist and rafter reinforcing cable guides; each of the joist and rafter reinforcing cable guides including an L-shaped joist securing plate assembly, a rafter securing plate, and a cable guide tube assembly; the L-shaped joist securing plate assembly including a vertical joist contact plate and a horizontal joist contact plate integrally formed with and orthogonally oriented with respect to the vertical joist contact plate; the vertical joist contact plate having two fastener apertures provided therethrough; the rafter securing plate being integrally formed with and orthogonally oriented with respect to a side edge of the horizontal joist contact plate and lying in a plane parallel to a plane defined by the vertical joist contact plate; the cable guide tube assembly including a tube support plate and a cable guide tube; the tube support plate having a cable passage aperture formed therethrough and being integrally formed with and extending from a side edge of the rafter securing plate perpendicularly oriented to the horizontal joist contact plate and having a bottom edge collinear with a fold line defining the edge between the horizontal joist contact plate and the rafter securing plate; the cable guide tube having a first open end defined by a tube end rigidly secured to the tube support plate such that a cable passage formed through the cable guide tube is in connection with the cable passage aperture and a longitudinal axis of the cable guide tube is oriented in parallel with a plane defined by the horizontal joist contact plate.

The structure stabilizing method includes the steps of a) providing a number of joist and rafter reinforcing cable guides as described above; b) attaching one each of the joist and rafter reinforcing cable guides to a number of sets of ceiling joists and rafters along each side of the building; c) threading a length of cabling through each of the cable guide tubes of each of the attached joist and rafter reinforcing cable guides; and d) anchoring the ends of the cable to the foundation of the structure to be stabilized.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
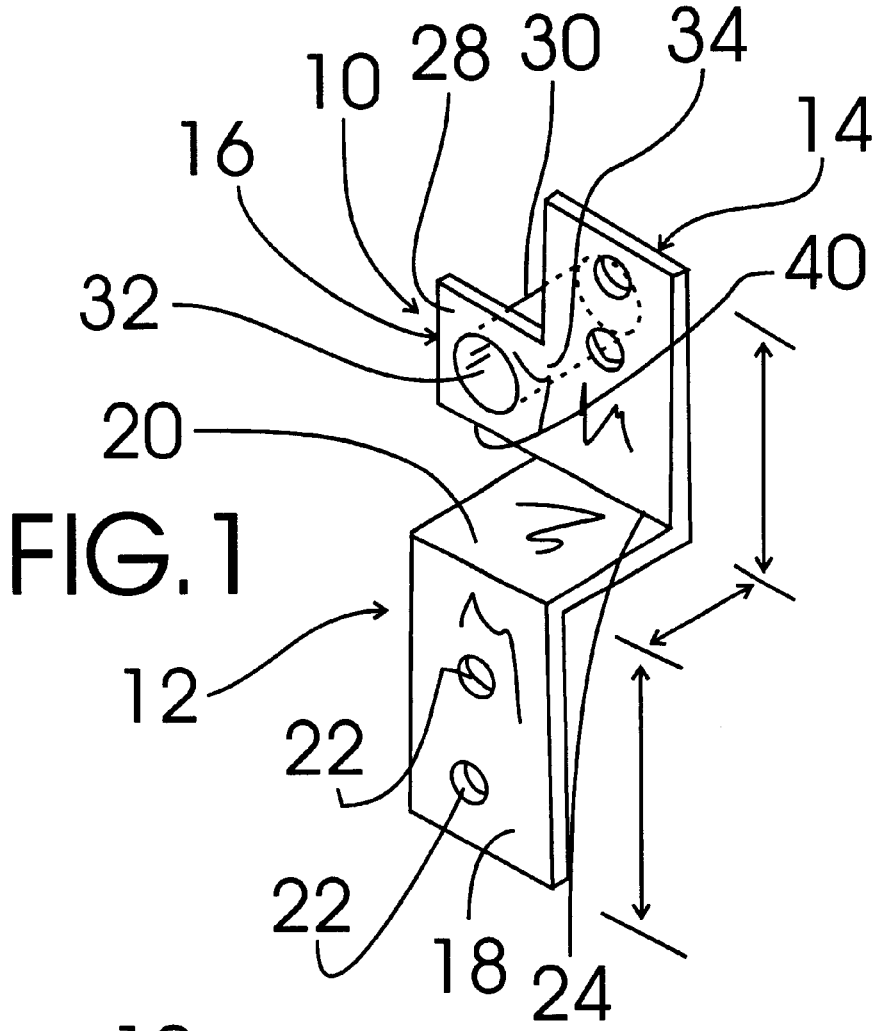
FIG. 1 is a perspective view of an exemplary embodiment of the joist and rafter reinforcing cable guide of the structure stabilizing system of the present invention showing the L-shaped joist securing plate assembly, the rafter securing plate, and the cable guide tube assembly; the L-shaped joist securing plate assembly including a vertical joist contact plate and a horizontal joist contact plate integrally formed with and orthogonally oriented with respect to the vertical joist contact plate; the vertical joist contact plate having two fastener apertures provided therethrough; the rafter securing plate being integrally formed with and orthogonally oriented with respect to a side edge of the horizontal joist contact plate and lying in a plane parallel to a plane defined by the vertical joist contact plate; the cable guide tube assembly including a tube support plate and a cable guide tube; the tube support plate having a cable passage aperture formed therethrough and being integrally formed with and extending from a side edge of the rafter securing plate perpendicularly oriented to the horizontal joist contact plate and having a bottom edge collinear with a fold line defining the edge between the horizontal joist contact plate and the rafter securing plate; the cable guide tube having a first open end defined by a tube end rigidly secured to the tube support plate such that a cable passage formed through the cable guide tube is in connection with the cable passage aperture and a longitudinal axis of the cable guide tube is oriented in parallel with a plane defined by the horizontal joist contact plate.

FIG. 1 shows an exemplary one of the number of identical joist and rafter reinforcing cable guides, generally designated 10, of the present invention. Each of the joist and rafter reinforcing cable guides is of steel construction and includes an L-shaped joist securing plate assembly, generally designated 12; a rafter securing plate, generally designated 14; and a cable guide tube assembly, generally designated 16. L-shaped joist securing plate assembly 12 including a vertical joist contact plate 18 and a horizontal joist contact plate 20 integrally formed with and orthogonally oriented with respect to vertical joist contact plate 18. Vertical joist contact plate 18 has two fastener apertures 22 provided therethrough.

Rafter securing plate 14 is integrally formed with and orthogonally oriented with respect to a fold line side edge 24 of horizontal joist contact plate 20 and lies in a plane parallel to a plane defined by vertical joist contact plate 18.

Figure 2:
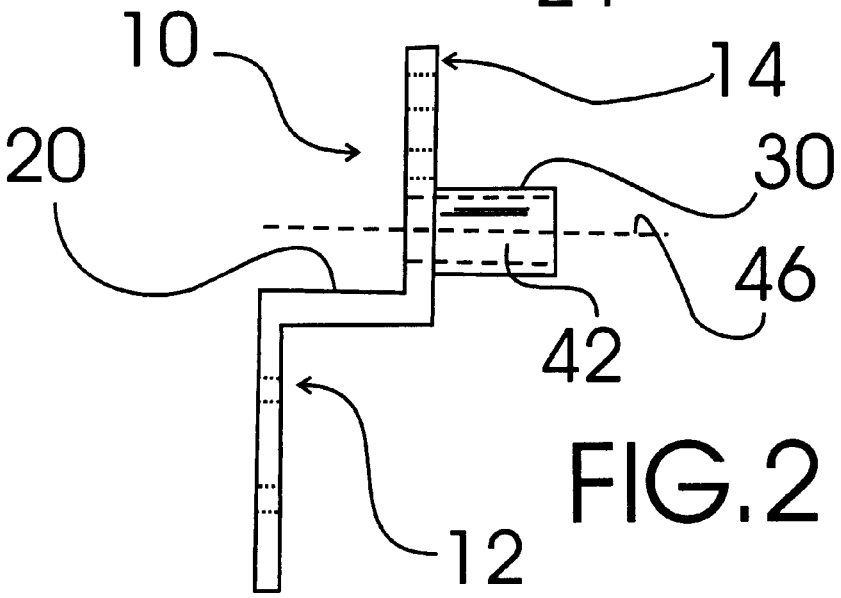
FIG. 2 is a side plan view of the joist and rafter reinforcing cable guide of FIG. 1.
Figure 3:
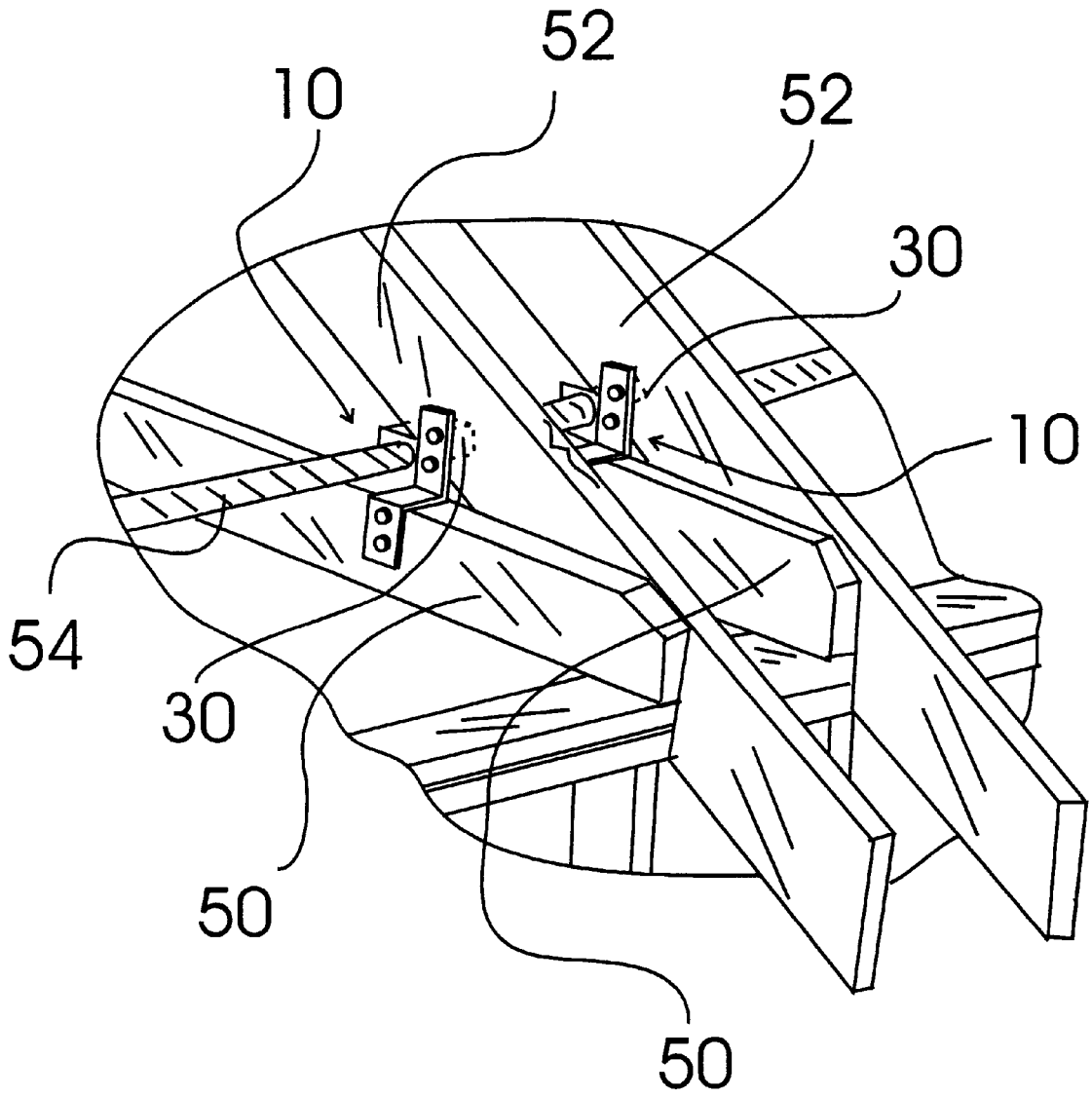
FIG. 3 is a partial perspective view of two of the joist and rafter reinforcing cable guides and a length of cable in use structurally reinforcing a representative section of ceiling joists and rafters supported on a representative top plate.
Figure 4:
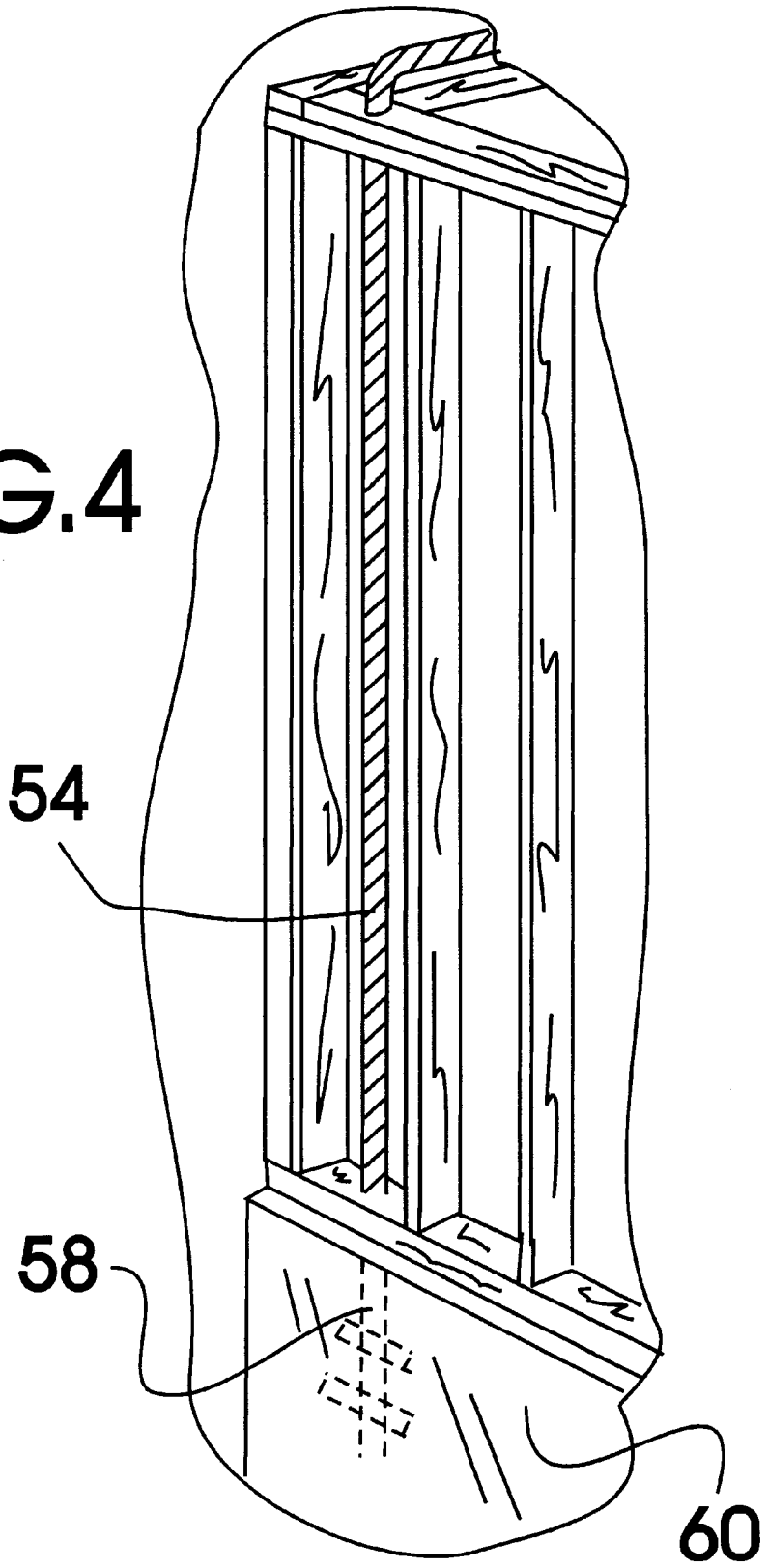
FIG. 4 is a partial perspective view showing the end of the section of steel cable anchored through the sill plate into the building foundation.

Cable guide tube assembly 16 includes a tube support plate 28 and a cable guide tube 30 (FIG. 2). Tube support plate 28 has a cable passage aperture 32 formed therethrough and is integrally formed with and extends from a side edge 34 (shown in dashed lines) of rafter securing plate 14 that is perpendicularly oriented to the horizontal joist contact plate 20 and has a bottom edge 40 collinear with a fold line side edge 24 between horizontal joist contact plate 20 and rafter securing plate 14.

Cable guide tube 30 has a first open end defined by a tube end rigidly secured to tube support plate 28 such that cable passage 42 (shown in dashed lines FIG. 2) formed through cable guide tube 28 is in connection with cable passage aperture 32 and a longitudinal axis 46 (shown in dashed lines) of cable guide tube 30 is oriented in parallel with a plane defined by horizontal joist contact plate 20.

An exemplary structure stabilizing method is now described with general reference to FIGS. 1–4. The structure stabilizing method includes the steps of a) providing a number of joist and rafter reinforcing cable guides 10 as described above; b) attaching one each of the joist and rafter reinforcing cable guides 10 to a number of sets of ceiling joists 50 and rafters 52 (FIG. 3) along each side of a structure to be stabilized; c) threading a length of cabling 54 through each of the cable guide tubes of each of the attached joist and rafter reinforcing cable guides 10; and d) anchoring the ends 58 (one shown in FIG. 4) of cabling 54 to the foundation 60 of the structure to be stabilized. The cabling 54 is torqued or tightened to a desired degree before securing cable end 58 to foundation 60. In existing structures, cable end 58 is preferably secured to a tie down structure secured to the ground.

It can be seen from the preceding description that a structure stabilizing system and method has been provided wherein the structure stabilizing system includes a length of cabling and a number of joist and rafter reinforcing cable guides; each of the joist and rafter reinforcing cable guides including an L-shaped joist securing plate assembly, a rafter securing plate, and a cable guide tube assembly; the L-shaped joist securing plate assembly including a vertical joist contact plate and a horizontal joist contact plate integrally formed with and orthogonally oriented with respect to the vertical joist contact plate; the vertical joist contact plate having two fastener apertures provided therethrough; the rafter securing plate being integrally formed with and orthogonally oriented with respect to a side edge of the horizontal joist contact plate and lying in a plane parallel to a plane defined by the vertical joist contact plate; the cable guide tube assembly including a tube support plate and a cable guide tube; the tube support plate having a cable passage aperture formed therethrough and being integrally formed with and extending from a side edge of the rafter securing plate perpendicularly oriented to the horizontal joist contact plate and having a bottom edge collinear with a fold line defining the edge between the horizontal joist contact plate and the rafter securing plate; the cable guide tube having a first open end defined by a tube end rigidly secured to the tube support plate such that a cable passage formed through the cable guide tube is in connection with the cable passage aperture and a longitudinal axis of the cable guide tube is oriented in parallel with a plane defined by the horizontal joist contact plate; and wherein the structure stabilizing method includes the steps of a) providing a number of joist and rafter reinforcing cable guides as described above; b) attaching one each of the joist and rafter reinforcing cable guides to a number of sets of ceiling joists and rafters along each side of the building; c) threading a length of cabling through each of the cable guide tubes of each of the attached joist and rafter reinforcing cable guides; and d) anchoring the ends of the cable to the foundation of the structure to be stabilized.

It is noted that the embodiment of the structure stabilizing system and method described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A structure stabilizing system comprising:

a length of cabling; and a number of joist and rafter reinforcing cable guides;

each of said joist and rafter reinforcing cable guides including an L-shaped joist securing plate assembly, a rafter securing plate, and a cable guide tube assembly;

said L-shaped joist securing plate assembly including a vertical joist contact plate and a horizontal joist contact plate integrally formed with and orthogonally oriented with respect to said vertical joist contact plate;

said vertical joist contact plate having two fastener apertures provided therethrough;

said rafter securing plate being integrally formed with and orthogonally oriented with respect to a side edge of said horizontal joist contact plate and lying in a plane parallel to a plane defined by said vertical joist contact plate;

said cable guide tube assembly including a tube support plate and a cable guide tube;

said tube support plate having a cable passage aperture formed therethrough and being integrally formed with and extending from a side edge of said rafter securing plate perpendicularly oriented to said horizontal joist contact plate and having a bottom edge collinear with a fold line defining said edge between said horizontal joist contact plate and said rafter securing plate;

said cable guide tube having a first open end defined by a tube end rigidly secured to said tube support plate such that a cable passage formed through said cable guide tube is in connection with said cable passage aperture and a longitudinal axis of said cable guide tube is oriented in parallel with a plane defined by said horizontal joist contact plate.

2. A structure stabilizing method comprising said steps of:

a) providing a length of cabling and a number of joist and rafter reinforcing cable guides;

each of said joist and rafter reinforcing cable guides including an L-shaped joist securing plate assembly, a rafter securing plate, and a cable guide tube assembly;

said L-shaped joist securing plate assembly including a vertical joist contact plate and a horizontal joist contact plate integrally formed with and orthogonally oriented with respect to said vertical joist contact plate;

said vertical joist contact plate having two fastener apertures provided therethrough;

said rafter securing plate being integrally formed with and orthogonally oriented with respect to a side edge of said horizontal joist contact plate and lying in a plane parallel to a plane defined by said vertical joist contact plate;

said cable guide tube assembly including a tube support plate and a cable guide tube;

said tube support plate having a cable passage aperture formed therethrough and being integrally formed with and extending from a side edge of said rafter securing plate perpendicularly oriented to said horizontal joist contact plate and having a bottom edge collinear with a fold line defining said edge between said horizontal joist contact plate and said rafter securing plate;

said cable guide tube having a first open end defined by a tube end rigidly secured to said tube support plate such that a cable passage formed through said cable guide tube is in connection with said cable passage aperture and a longitudinal axis of said cable guide tube is oriented in parallel with a plane defined by said horizontal joist contact plate;

b) attaching one each of said number of joist and rafter reinforcing cable guides to a number of sets of ceiling joists and rafters along each side of a structure to be stabilized;

c) threading a length of cabling through each of said cable guide tubes of each of said attached joist and rafter reinforcing cable guides; and d) anchoring ends of said cable to a foundation of said structure to be stabilized.

* * * * *